United States Patent [19]

Ray

[11] Patent Number: 4,542,900

[45] Date of Patent: Sep. 24, 1985

[54] EXERCISE OR THERAPY DEVICE OR APPARATUS

[75] Inventor: David B. Ray, Huntsville, Ala.

[73] Assignee: Versatile Equipment Co., Inc., Oxford, Ala.

[21] Appl. No.: 538,790

[22] Filed: Oct. 4, 1983

[51] Int. Cl.[4] ..... A63B 21/02

[52] U.S. Cl. ..... 272/134; 272/117; 272/118; 272/DIG. 4

[58] Field of Search ..... 272/116, 117, 118, 128, 272/134, 138, 139, 144, 145, 93, 129, 130; 128/25 B, 25 R

[56] References Cited

U.S. PATENT DOCUMENTS

| | | | |
|---|---|---|---|
| D. 263,978 | 4/1982 | Brentham | D21/195 |
| 2,855,199 | 10/1958 | Noland et al. | 272/117 |
| 3,850,430 | 11/1974 | Hamilton | 272/117 |
| 4,256,302 | 3/1981 | Keiser et al. | 272/118 |

FOREIGN PATENT DOCUMENTS

| | | | |
|---|---|---|---|
| 1139665 | 1/1969 | United Kingdom | 128/25 R |

*Primary Examiner*—Richard J. Apley
*Assistant Examiner*—Robert W. Bahr
*Attorney, Agent, or Firm*—William R. Hinds

[57] ABSTRACT

An exercise or therapy device provides for the foot to be fixed and the knee to be biased to a flexed position such that the quadriceps muscles straighten the leg or extend the knee against resistance. Preferably the user is seated with his foot or feet fixed against a foot support, and the posterior of the knee is engaged by a movable member which biases the knee in a flexing direction with a selectable force. The seat preferably is movable back and forth to accommodate the flexing and extending of the knee. The femur is not fixed as in many machines where the knee is fixed and the foot moves. The device is particularly suited for strengthening of the quadriceps, but is useful in connection with many different types of knee therapy or knee strengthening. The device is also effective for strengthening the hip flexors and extensors and the hamstrings. A basic concept of the device involves its simulation of natural sports activity involving running, in which the foot is planted and the knee moves to accommodate the activity. Various adjustments are provided on the device to accommodate different users. Preferred versions of the device are assembled in a unitary frame.

20 Claims, 3 Drawing Figures

EXERCISE OR THERAPY DEVICE OR APPARATUS

FIELD OF THE INVENTION

This invention relates to physical exercise or therapy devices or apparatus, particularly for strengthening the quadriceps of the leg through repetitive movement against a selectable force, but also useful for strengthening the hamstrings and hip flexors and extensors, and useful to strengthen the knees for the prevention of injuries, and in many different types of knee pathology or problems, such as those involving torn menisci, ligamentous instability, and patella problems. In addition to these primary purposes and features, preferred embodiments of the invention permit other beneficial exercises.

BACKGROUND

The field of exercise or therapy devices for the knee and upper leg muscles is and has been an active one, involving various approaches, devices and apparatus permitting repetitive exercises against selective or variable resistances and forces. Exemplary of these are those shown in U.S. Pat. No. 2,855,199 issued Oct. 7, 1958 (Noland et al), U.S. Pat. No. 3,850,430 issued Nov. 26, 1974 (Hamilton), U.S. Pat. No. 4,256,302 issued Mar. 17, 1981 (Keiser et al) and U.S. Pat. No. D. 263,978 issued Apr. 20, 1982 (Brentham). Devices as shown in these patents are useful to greater or lesser extents. However, in general they all follow a similar approach whereby the repetitive exercises involve fixing the femur, and having the quadriceps and hamstrings extend and flex the knee through movement of the foot. While this approach can be beneficial, I consider that it does not properly simulate natural sports activity involving running. Thus, all activities that involve running generally have the foot planted, and the knee moves to accommodate the activity. Therefore, it is a basic concept of my invention that the foot be fixed, and that the quadriceps muscles extend the knee against resistance, while controlled return of the knee to a flexed condition exercises the hamstrings. In devices according to my invention, the femur is not fixed, and thus there is less apparent force on the patella femoral joint. Additionally, devices in accordance with my invention achieve a unique degree of isolation of the quadriceps muscles during use. I know of no device or apparatus in the prior art that possesses the unique features, functions and advantages of devices and apparatus in accordance with my invention.

A primary purpose of my invention is to provide a unique quadriceps strengthening machine that allows strengthening of the quadriceps in a way that is better related to natural sports activity. Machines in accordance with my invention may also be used on many different types of knee pathology, as well as to strengthen knees for the prevention of injuries. Knee problems involving torn menisci, ligamentous instability, and patella problems may be advantageously treated on machines in accordance with my invention as approved by the physician and therapist. Machines in accordance with my invention also are very efficient hip flexor strengtheners, and the hip extensors and the hamstrings can be advantageously worked on to improve their strength. Machines according to my invention, while fairly specialized in their primary purposes, are embodied in preferred embodiments of substantial versatility in other types of exercise. Accordingly, my invention can be characterized not only by its primary purposes, features and concepts, but also by its versatility, simplicity, reliability, and ease of use.

The various aspects and features of my invention will become apparent to those skilled in the art from the ensuing description of presently preferred embodiments, taken in conjunction with the accompanying drawings.

DETAILED DESCRIPTION OF EMBODIMENTS

Figure 1:
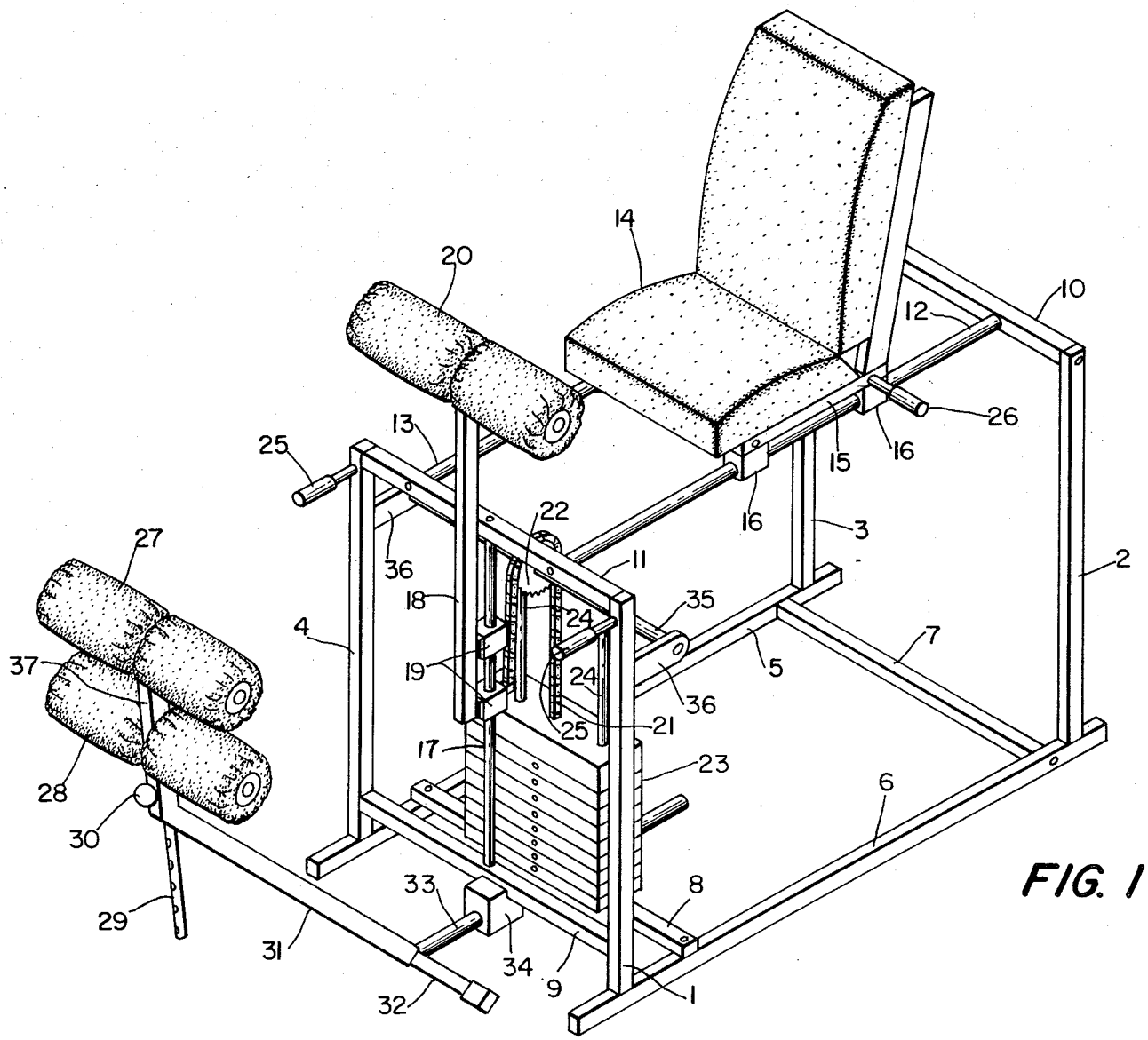
FIG. 1 is a perspective view of a device incorporating the main features of a presently preferred embodiment of my invention.

Referring to FIG. 1 of the drawings, the illustrated embodiment comprises a framework made up of two forward vertical members 1 and 4 and two rear vertical members 2 and 3, interconnected by side base members 5 and 6, cross base members 7 and 8, upper cross members 10 and 11, and cross member 9. All of these members are steel members of square or rectangular section. Metal rods 12 and 13 are connected between upper cross members 10 and 11. This assemblage of interconnected members forms a strong rigid frame. A seat 14 is slidably supported on rods 12 and 13 by a metal base 15 which carries sleeve bearing members 16, so as to permit free movement of seat 14 forwardly and rearwardly along guide rods 12 and 13. A conventional locking member, not shown, may be provided as part of the seat to lock the seat in position at selected locations, although in the normal use of the device, seat 14 moves freely back and forth with the user. Side handles, one of which is shown at 26, extend from the rigid structure of seat 14 at both sides for grasping by the user.

A guide rod 17 is connected to and extends between lower and upper cross members 9 and 11. Knee engaging padded roller members 20 are rotatably mounted to upright mounting member 18 which, at its lower end, carries sleeve bearing members 19 for slidably and guidably mounting roller members 20 to guide rod 17 so as to permit the assembly comprising knee engaging roller members 20 to move vertically upwardly and downwardly. Upward force is applied to the knee engaging members 20 by a roller chain or the like 21 which is connected at one end to one of the sleeve bearing members 19, and passes around a sprocket 22 to connect with a weight selection pin which extends down through weight members 23, this arrangement constituting a conventional weight selection system whereby a selected number of weights to be lifted is effected by removal and reinsertion of a pin or the like through openings in or between the weight members 23 to engage with the pin carried by chain 21. This is a well-known form of weight selection which, in itself, forms no part of the instant invention, and which may be of the type shown, for instance, in U.S. Pat. No. 4,256,302. The weight members 23 are guided by upright rods 24 which are connected at their lower ends to cross member 8, such that the selected number of weights are guided in their vertical movement by the rods 24 in a well-known manner. As shown, sprocket 22 is freely rotatable on or with a shaft 35 supported by upright members 1 and 4 via brackets 36.

The frame also includes handles 25 for grasping by the user to steady the user for various exercises with the seat 14 in the fully forward position.

Foot engaging rollers 27 and 28 are rotatably supported by a member 37, which in turn is vertically adjustably supported via an apertured rod 29 and engageable pin 30 to the upper end of a member 31. Vertical adjustment of the foot roller members is by disengaging pin 30 from an aperture in rod 29, and reengaging the pin after the roller members are set at a desired height. Supporting member 31 carries a transverse steadying member 32 at its lower end, and is horizontally adjustably connected with the frame via rod 33 which passes through bearing member 34 connected to cross member 9. A similar bearing member, not shown, is carried by cross member 8, and either of the bearing members may have a releasable wing bolt or the like for securing rod 33 in its desired adjusted position to suit the physical dimensions of the user.

From the foregoing, it will be readily apparent that knee engaging roller members 20 will be held in a normal raised position by the weight of members 23 applied via roller chain 21. This raised normal position, which may be adjusted by varying the attachment of roller chain 21 to bearing member 19, typically lies well above an imaginary line extending from the forward surface of seat 14 to the foot engaging lower surface of foot roller members 27. Therefore, a user seated in seat 14, with his feet engaged beneath foot roller members 27, will have his legs substantially flexed, with the posterior knee surfaces flexed about the upper surfaces of knee roller members 20. The knees can be extended by tensioning the quadriceps so as to move knee roller members 20 downwardly against the selected resistance posed by weights 23. The knees can be thus fully or partially extended as desired, repetition of this serving to strengthen the quadriceps. Since the knee roller members 20 are being constantly urged upwardly, controlled flexing of the knees after full or partial extension also exercises the hamstring muscles. Seat 14 normally moves rearwardly on knee extension and forwardly on knee flexion. During knee flexion, the upper surfaces of the feet normally engage beneath roller members 27, and when the knees are extended the upper feet portions or lower ankle portions of the user move beneath rollers 27. Lower rollers 28 are really unnecessary for basic use of the machine, but they are advantageous in steadying the feet, as a rest for the feet during periods of nonexercise, and as providing a further measure of adjustability, in that either the upper roller members or the lower roller members can be engaged by the feet of a user.

In addition to the particular purpose of the device in strengthening the quadricep muscles as previously described, other exercises with the preferred form of the device are easily effected. Thus, with the seat 14 moved to and locked in its extreme rearward position, the user can extend his legs and rest the ankles on the roller members 20. Forcing the legs downwardly in this position, while grasping seat handles 26, exercises the hamstrings and hips. Furthermore, the seat can be moved fully forward and locked in position, with the legs of the user hanging freely over the roller members 20. The user can then grasp frame handles 25, and force his upper legs downwardly against the resistance. Still further, with the seat in the forward position, the weight members 23 can be released, weights can be connected to member 18, and the legs of the user can be passed under roller members 20. Lifting the legs and roller members 20 against the downward force of the weights while grasping handles 25 or 26 is an advantageous exercise.

Although not illustrated in FIG. 1, it is contemplated that accessory roller members be provided as alternatives to the illustrated roller members 20, 27 and 28. Such accessory roller members may be particularly adapted for exercise of only one leg at the time, and thus would essentially comprise single roller attachments for engagement by one leg, without the encumbrance of the additional roller of the illustrated double roller members. Furthermore, for added stability, double guide bars 17 may be provided, spaced from each other, and each guiding laterally spaced sleeve bearings 19, which would be interconnected and connected to upright member 18. Such an arrangement would avoid any pivotal movement of member 18 and roller members 20 about the axis of a single guide bar 17. Still further, it is clearly within the scope of the preferred embodiment of FIG. 1 to locate the weight members 23 at the rear of the frame by providing additional sprockets, which would facilitate the use of added weights. Still further, the embodiment of FIG. 1 could be modified to provide for a limited amount of back and forth pivotal movement of roller members 20 and 27 about pivot axes incorporated in their upright support members, this slight pivotal movement tending to compensate for and accommodate the effective changes in leg length during flexing and extending. Finally, while I prefer the roller members 27 as the foot supports, suitable strap members could be provided to pass around the anterior surfaces of the feet or ankles.

Figure 2:
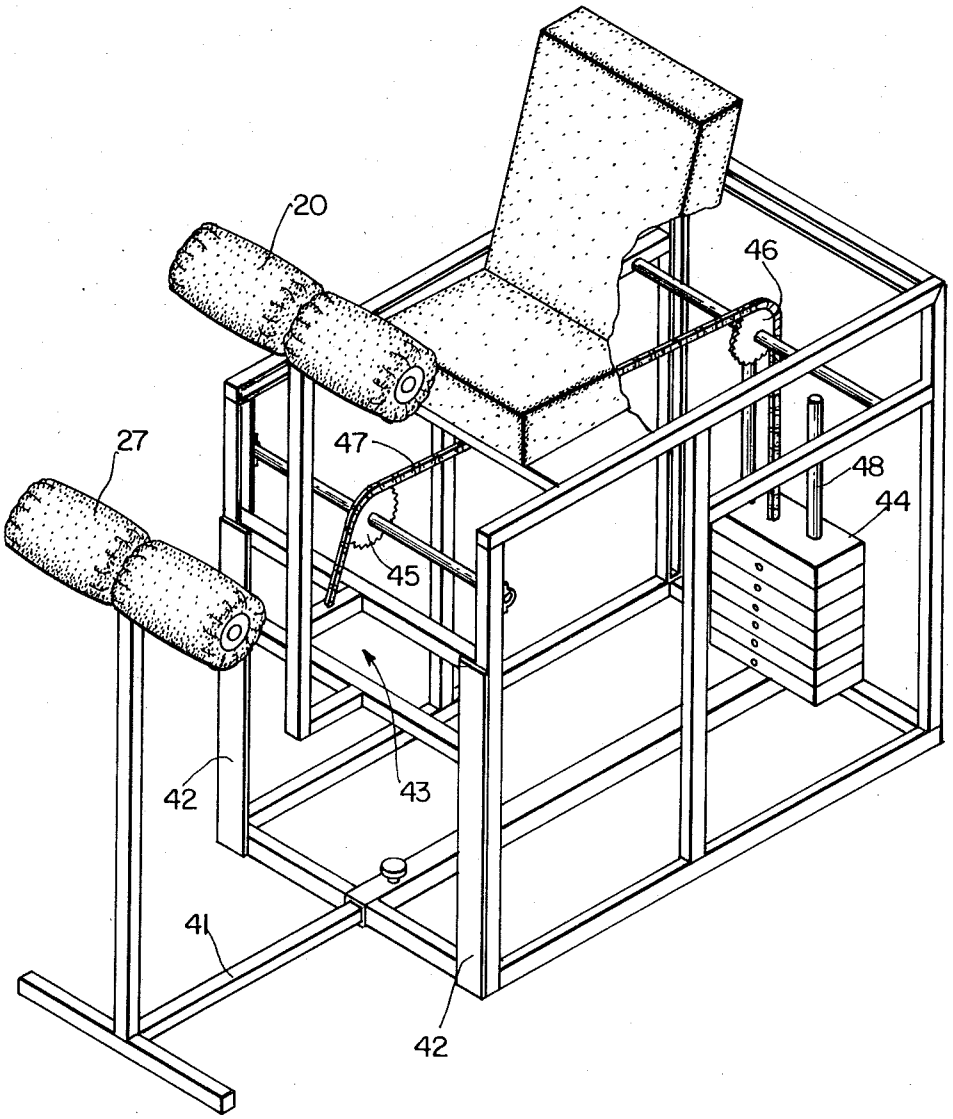
FIG. 2 is a perspective view of an alternative embodiment.

Although structurally different, the embodiment of FIG. 2 is conceptually the same as the embodiment of FIG. 1. In the embodiment of FIG. 2, the foot roller members are horizontally adjustable by a telescoping movement of member 41 into a central base frame member. The guide structure for the knee roller members in the embodiment of FIG. 2 comprises a modified framework 43 guided vertically by end roller members (not shown) riding in U-sectioned front upright members of the frame, with or without flange extensions 42. Alternatively, the rollers can be guided by flanging members 42. Upward force is applied to frame 43 via roller chain 47 which passes around sprockets 45 and 46 to selectively connect with weight members 44 located at the rear of the device and guided by upright rods 48. In the same manner as frame 43, the illustrated seat is mounted for movement back and forth by roller members traveling in U-sectioned upper side members of the frame. Operationally the embodiment of FIG. 2 may be considered as the same as the embodiment of FIG. 1.

Figure 3:
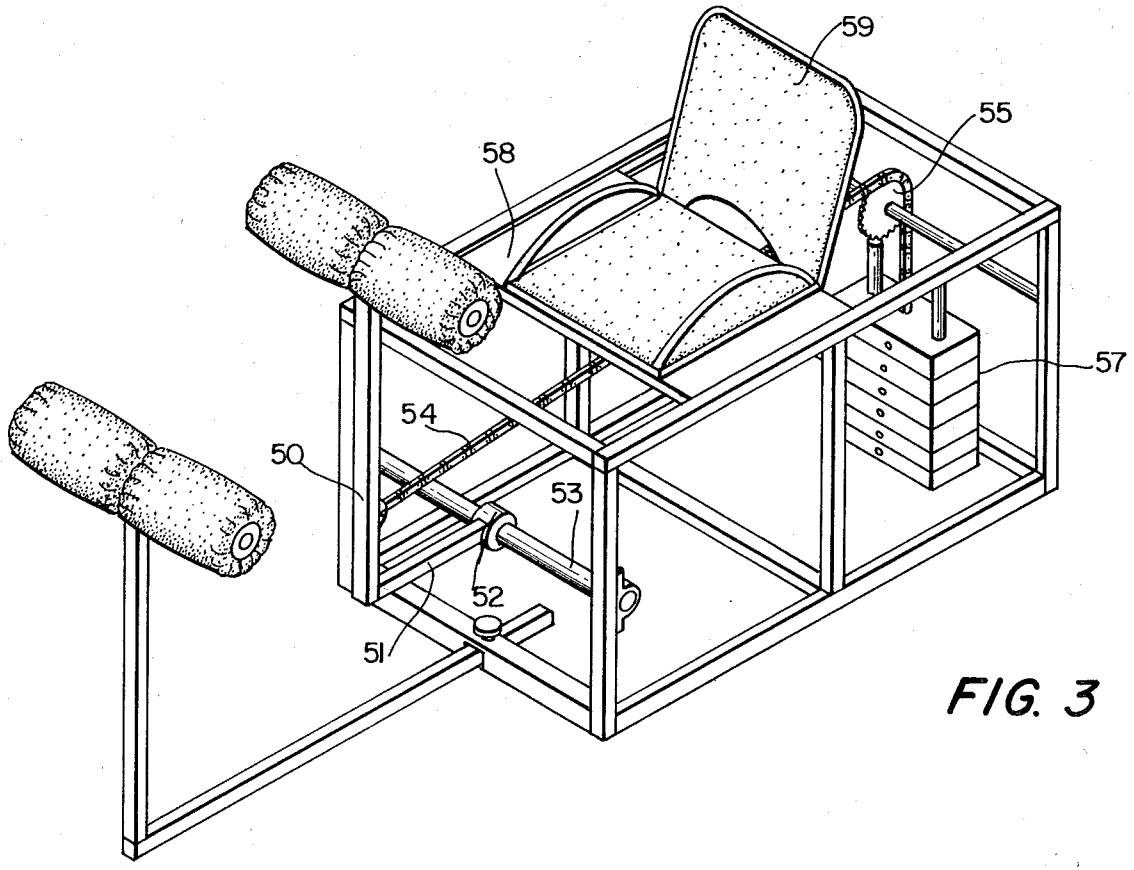
FIG. 3 is a perspective view of a further alternative embodiment which, although workable, is a relatively less preferred embodiment.

In the embodiment illustrated in FIG. 3, movement of the knee roller members is by way of pivotal movement of supporting members 50 and 51 about shaft 53, member 51 being journaled to shaft 53 via a bearing member or the like 52. The arcuate path of the up and down movement of the knee roller members in accordance with this embodiment is presently not preferred, but it is workable and effective. The upward biased force is applied to the knee roller members via chain 54 connected at one end to member 50 and passing around rear mounted sprocket 55 to selectively connect at its other end with weight members 57. In this embodiment, seat 59 is mounted on a platform 58 which carries at its ends roller members which are guided in U-sectioned upper side members. Apart from the arcuate movement of the knee roller members in this embodiment versus the substantially rectilinear movement in the embodiments of FIGS. 1 and 2, the operations may be considered substantially the same.

Although all three illustrated embodiments utilize a sitting position and substantially vertical movement of the knee engaging roller members, it will be understood that the concept of the invention may be embodied in a generally vertically oriented arrangement, whereby the user would be subsantially upright, the foot roller members would be located lowermost to restrain the foot against horizontal movement, and the knee roller member would be biased in a generally horizontal direction, as opposed to the vertical directions of the illustrated embodiments. It is a simple matter to arrange the chains and sprockets so as to bias the knee support rollers either horizontally or upwardly. The illustrated seated embodiments are preferred presently because of the unique isolation which they provide for the quadriceps muscles, and because of their ease of use and the limited tiring strains which they place on other muscles of the body while in use.

Having thus described and illustrated exemplary and preferred embodiments of my invention, it is to be understood that my invention is not limited to the illustrated and described details, and that various changes in these details may be made within the concept and spirit of the invention. The scope of the invention itself is as defined in the subjoined claims, taken in light of the foregoing description and illustrations.

I claim:

1. Exercise apparatus comprising fixed means for bearing against the anterior part of the lower leg or ankle or foot of a user, movable means for bearing against the posterior part of the leg in the area of the knee joint of a user and movable relative to said fixed means, means positioning said fixed means and said movable means such that a seated user sitting adjacent said movable means on the side thereof relatively away from said fixed means can pass a leg over said movable means and beneath said fixed means, and means yieldably biasing said movable means toward a normal position in which a user with a lower leg portion bearing against said fixed means will have his knee flexed about said movable means, such that extending of the knee and straightening of the leg necessitates moving said movable means from said normal position against the force of said yieldable biasing means.

2. Apparatus as claimed in claim 1 further comprising means for positioning the hips of a user such that said movable means in its normal position lies offset from an imaginary line between the user's hips and said fixed means, and wherein said movable means is movable back and forth generally toward and away from the imaginary line.

3. Apparatus as claimed in claim 2 wherein said means for positioning the hips comprises a seating surface, said fixed means is disposed generally horizontally away from said seating surface, and said movable means is movable generally upwardly and downwardly between said seating surface and said fixed means, and in its normal position lies above a line between the two.

4. Apparatus as claimed in claim 3 further comprising means mounting said seating surface for generally horizontal movement toward and away from said movable means to accommodate flexing and extending of the knee of a user.

5. Apparatus as claimed in claim 4 wherein the force of said yieldable biasing means is selectively variable.

6. Apparatus as claimed in claim 5 wherein said movable means is mounted for rectilinear reciprocation.

7. Apparatus as claimed in claim 6 wherein said seating surface is mounted for rectilinear reciprocation.

8. Apparatus as claimed in claim 7 wherein the horizontal distance between said fixed means and said movable means is adjustable.

9. Apparatus as claimed in claim 8 wherein the vertical distance between said fixed means and the normal position of said movable means is adjustable.

10. Apparatus as claimed in claim 9 wherein said movable means and said fixed means comprise padded roller members.

11. Apparatus as claimed in claim 10 wherein said padded roller members are configured such that they can accommodate both legs of a user at the same time.

12. Apparatus as claimed in claim 11 wherein said yieldable bias means comprises weights connected to said movable means through a flexible line and pulley system.

13. An exercise device comprising a support surface for the torso of a user, relatively stationary foot support means disposed frontwardly of said support surface for engagement by a lower leg portion or foot of the user to at least limit the lower leg portion or foot against upward movement, relatively movable knee engaging means located between said foot support means and said torso support surface for bearing against the posterior surface of the knee area of the leg of the user, means mounting said knee engaging means for movement relative to said foot support means between a normal raised position in which the leg of the user is flexed about the knee engaging means and a lower position in which the leg of the user is relatively straightened and the knee is relatively extended, and force means yieldably biasing said knee engaging means to its raised position.

14. An exercise device as claimed in claim 13 wherein said device comprises a frame structure, and said torso support surface comprises a seat surface movably mounted on said frame for movement forwardly and backwardly to accommodate flexing and extending of the knee of the user.

15. An exercise device as claimed in claim 14 wherein said frame structure includes upright guide means forwardly of and below said seat surface for guiding said knee engaging means in a path between said raised and lower positions.

16. An exercise device as claimed in claim 14 wherein said foot support means is adjustably coupled to said frame structure for selective adjustment forwardly and rearwardly.

17. An exercise device as claimed in claim 14 wherein said foot support means includes means for effecting vertical adjustment thereof.

18. An exercise device as claimed in claim 14 wherein said foot support means and said knee engaging means each comprise at least one padded roller for engaging areas of at least one leg of the user.

19. An exercise device as claimed in claim 14 wherein said frame structure comprises front and rear upright main frame members, said seat surface forms part of a seat with a supporting back for supporting a user in a generally upright sitting position, said seat is movably supported on seat guide members interconnecting the upper ends of said main frame members, said means mounting said knee engaging means is connected to said front main frame member, said foot support means is connected to and extends forwardly from said front main frame member, and said force means includes a plurality of weights carried within said frame and coupled to said mounting means for said knee engaging means by a flexible line and pulley system.

20. Exercise apparatus comprising hip positioning means for positioning the hips of a user, lower leg positioning means for positioning the lower part of a leg of a user, means restraining said hip positioning means and said lower leg positioning means against substantial movement laterally of an imaginary line connecting them, and knee engaging means movable relative to said hip and lower leg positioning means for engaging the posterior portion of the knee of a user and yieldably biasing the knee laterally away from said imaginary line in a direction to flex the leg of the user and require the user to overcome said bias in order to extend the leg and knee.

* * * * *